US006655417B2

(12) United States Patent
Kurmis

(10) Patent No.: US 6,655,417 B2
(45) Date of Patent: Dec. 2, 2003

(54) TOOL FOR BINDING AN OBJECT, IN PARTICULAR A CABLE HARNESS

(75) Inventor: Viktor Kurmis, Pinneberg (DE)

(73) Assignee: Hellermann Tyton GmbH, Tornesch (DE)

( * ) Notice: Subject to any disclaimer, the term of this patent is extended or adjusted under 35 U.S.C. 154(b) by 0 days.

(21) Appl. No.: 10/074,069

(22) Filed: Feb. 12, 2002

(65) Prior Publication Data

US 2002/0108664 A1 Aug. 15, 2002

(30) Foreign Application Priority Data

Feb. 12, 2001 (EP) ..... 01103244

(51) Int. Cl.[7] ..... B21F 9/02
(52) U.S. Cl. ..... 140/93 A; 140/93.2; 140/123.6
(58) Field of Search ..... 140/57, 93 A, 140/93.2, 119, 123.6, 123

(56) References Cited

U.S. PATENT DOCUMENTS 3,621,889 A * 11/1971 Hidassy ..... 140/93.2
4,004,618 A 1/1977 Turek

FOREIGN PATENT DOCUMENTS

EP 0 897 866 A1 2/1999

* cited by examiner

*Primary Examiner*—Lowell A. Larson
(74) *Attorney, Agent, or Firm*—Alix, Yale & Ristas, LLP

(57) ABSTRACT

The invention relates to a tool for binding an object, in particular a cable harness, by means of a band, having a tool body (1) and a clamp (2) which is at least partially formed by clamp parts (3, 3'), mounted in a movable manner on the tool body (1), and is provided with a band guide, it being possible for the clamp parts (3, 3') to be closed such that, in a closed state of the clamp (2), a free space (6) is produced between their free ends, it being the case that arranged at the free end of at least one of the clamp parts (3, 3') is a slide (5, 5') which can be moved between a position in which it releases the free space (6) and a closing position and, at least in its closing position, forms part of the band guide. The invention also covers an arrangement having the abovementioned tool and a band for binding an object.

20 Claims, 2 Drawing Sheets

TOOL FOR BINDING AN OBJECT, IN PARTICULAR A CABLE HARNESS

BACKGROUND OF THE INVENTION

The invention relates to a tool for binding an object, in particular a cable harness, by means of a band, having a tool body and a clamp which is at least partially formed by clamp parts, mounted in a movable manner on the tool body, and is provided with a band guide, it being possible for the clamp parts to be closed such that, in a closed state of the clamp, a free space is produced between their free ends.

A tool of this type is known from EP-A-0 897 866. It has a tool body, on the end side of which there are arranged clamp parts which, in their closed state, form a wraparound clamp. The wraparound clamp is closed around the object which is to be bound and, in this state, forms a continuous guide for a band which is to be bound around the object by the tool. For this purpose, the clamp parts have, on their inwardly directed side, a guide groove which is in connection with a band guide in the interior of the tool. The guide groove, however, does not continue at the location at which, in the closed state, the clamp parts butt against one another by way of their two free ends. This is because the clamp parts each have a cutout at their free ends. These cutouts serve for forming a free space, in the closed state of the clamp parts, in order to accommodate therein a fastening element, e.g. a band eyelet, by means of which the band which is to be bound is fastened on a carrying structure. The band eyelet is designed such that it fits into the free space formed by the cutouts and supplements that region of the band guide in the clamp which is missing on account of the cutouts. Overall, this reinstates a continuous guide for the band. In order for the tool to be adapted to different band eyelets with different dimensions, the clamps are exchangeable. For this purpose, the clamp parts are divided into inner and outer parts, the outer parts of the clamp parts being fastened in an exchangeable manner. It is thus possible, by correspondingly exchanging the outer parts, for the tool to be adapted to different fastening eyelets. Exchanging the outer parts, however, is time-consuming and requires a corresponding assortment of outer parts, in order to have the appropriate outer parts in each case for different band eyelets. Moreover, this also increases the cost.

U.S. Pat. No. 3,810,498 discloses a tool in the case of which a band guide formed by a clamp does not fully enclose the object which is to be bound, that is to say whenever the clamp parts, on account of having an excessively large object between them, cannot close to the full extent. This produces a free space in which no band guidance is provided. As a result, it may be comparatively easy for the band which passes out of the band guide on one clamp part, and is displaced without guidance via the free space, to come into contact incorrectly with the band guide of the other clamp part. This results in frequent malfunctioning.

The object of the invention is to provide a tool of the type mentioned in the introduction which avoids, or at least reduces, the abovementioned disadvantages.

SUMMARY OF THE INVENTION

In the case of a tool for binding an object, in particular a cable harness, by means of a band, having a tool body and a clamp which is at least partially formed by clamp parts, mounted in a movable manner on the tool body, and is provided with a band guide, it being possible for the clamp parts to be closed such that, in a closed state of the clamp, a free space is produced between their free ends, the invention provides that arranged at the free end of at least one of the clamp parts is a slide which can be moved between a position in which it releases the free space and a closing position and, at least in its closing position, forms part of the band guide. The invention is based on the idea that it is possible, by means of the movable slide according to the invention, on the one hand, for the clamp to be closed such that remaining between the free ends of the clamp parts is a free space for accommodating a fastening means to which the object which is to be bound is to be connected by the band or, on the other hand, to have a complete band guide even when it is intended not to use any fastening means.

The tool according to the invention thus has the advantage that it can be used both for binding bands with the inclusion of a fastening means and for binding without fastening means, to be precise without the tool having to be changed in any way for this purpose. Rather, the tool automatically adapts itself as to whether the binding is to be carried out with the inclusion of a fastening means or not. In this way, the tool can be adapted cost-effectively to different binding requirements.

It is not absolutely necessary for the slide always to be moved fully into the releasing position by the fastening means. It is also possible to use fastening means of smaller dimensions, in which case the slides then only move out of their closing position to the extent where a passage which is necessary for the fastening means is released. Similarly, it is also the case that it is not absolutely necessary for the slides, in their closing position, to close the free end of the clamp to the full extent; a slight gap remaining between the slide and the free end of the opposite clamp part usually does not impair the band guide.

The clamp part advantageously has a cutout which forms the free space. Such a cutout achieves the situation where the tool is reliably set in position and retained, correctly in relation to the fastening means which is to be included. It is expedient here if the free ends of the clamp parts are provided with a formfitting connection to the fastening means. This ensures that the band guide also continues smoothly in the region of the fastening means, with the result that there is no risk of any disruption, during the wraparound operation, by the band being prevented from passing at this location. It is advantageous if, at their free end, the clamp parts have at least one finger which is designed for engaging behind the fastening means with a form fit. The finger serves for reliably retaining the tool on the fastening means. This avoids the situation where, in the closed state of the clamp, the tool, during the binding operation, loses its connection to the fastening means, as a result of an undesired movement, and the band-guiding quality is thus impaired.

A spring is expediently provided at the free end of the clamp part, it being possible for the slide to be moved counter to the force of said spring. This achieves the situation where the slide can move automatically and without the user having to subject the tool to any additional manipulation. It is thus possible for the user to carry out binding operations alternately with or without the inclusion of a fastening means, without having to make any changes to the tool or to the clamp parts for this purpose.

Expediently provided at the free end of the clamp part is a cavity which is dimensioned for accommodating the slide. The cavity is advantageously of at least partially curved design. This makes it possible to provide, even in the case of small clamps with small diameters, a cavity which is suitable for accommodating comparatively large slides. In the region of the cavity intended for accommodating the slide, the curvature of said cavity expediently corresponds to a curvature of the slide which may be present.

A section of the clamp part which bounds the cavity inside the clamp is expediently of wedge-shaped design. This wedge-shaped design achieves a relatively uniform transition of the band guide between the slide and the clamp part, this reducing the risk of the course of the band being obstructed.

The slide expediently has a hollow on its side which forms part of the band guide. By virtue of this hollow, the band, as it runs up against the slide, is curved slightly in the hollow and is guided away from the slide at a slight acute angle. This likewise facilitates the transfer of the band at the free end of the clamp from one clamp part to the other clamp part, in particular as regards re-entrance into the band guide on the opposite clamp part.

Provision is expediently made for the slides to be provided on each of the two clamp parts. They are expediently of different dimensions.

The invention also covers an arrangement for binding an object, having a band and a tool. The tool here corresponds to the tool described above.

BRIEF DESCRIPTION OF THE DRAWINGS

The invention is explained in more detail hereinbelow with reference to the drawing, which gives a schematic illustration of an advantageous exemplary embodiment and in which.

DETAILED DESCRIPTION OF THE PREFERRED EMBODIMENTS

The tool has a tool body 1 with a handle, arranged in a gun-like manner, in its rear region and with a clamp 2 at its front end. As is known, the tool contains a drive motor and a control device for different tool functions, in particular the movement of the clamp 2 and the tensioning of a band. The clamp 2, formed from two clamp parts 3, 3', is arranged on the front end side of the tool body 1. The clamp parts 3, 3' are mounted in a movable manner on the tool body 1. Provided within the tool body is a band guide (not illustrated) which is adjoined, within the clamp 2, by a further band guide designed as a guide groove 33 in the clamp parts 3. A band which passes out of the end of the tool body 1 with the free end in front is guided through the guide groove 33, around the object which is to be bound, and back to the tool body 1, in order, finally, for the binding to be completed there.

Figure 1:
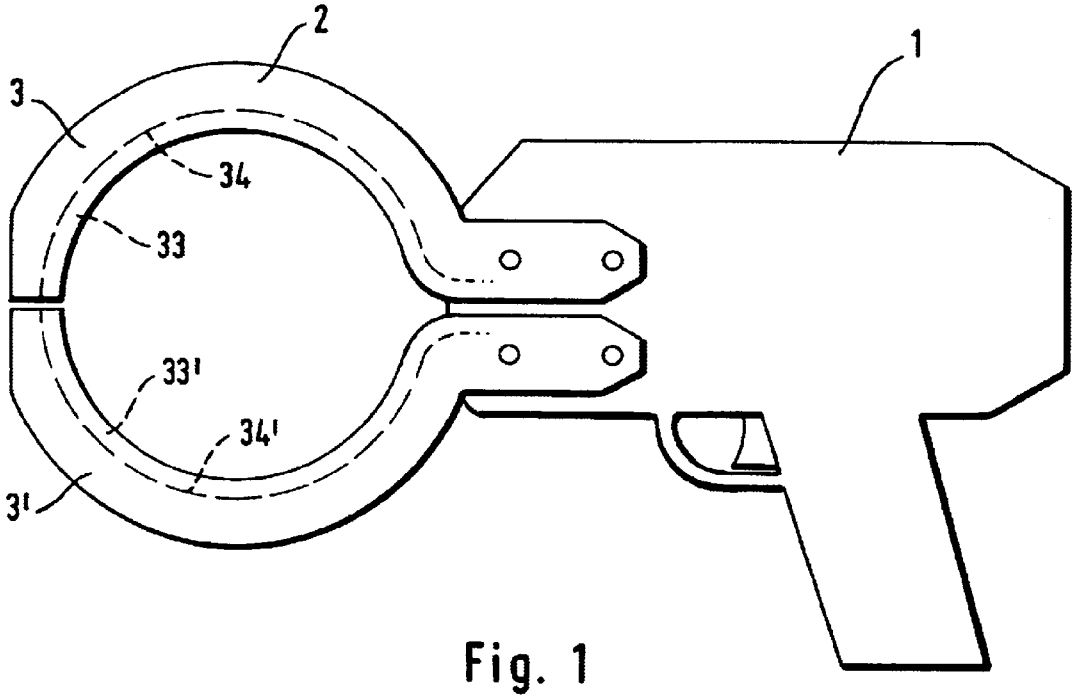
FIG. 1 shows a schematic side view of the tool.
Figure 2:
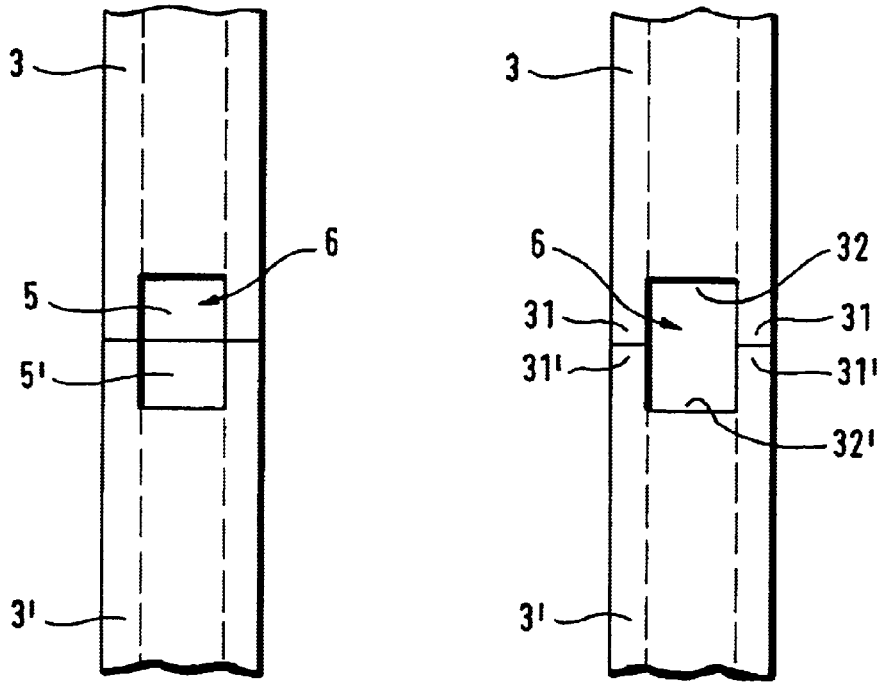
FIG. 2 shows front views of the free ends of clamps of the tool.

The front end of the clamp 2 of the tool 1, at which the clamp parts 3, 3' butt against one another in the closed state, is illustrated in a front view in FIG. 2. In the two halves of FIG. 2, the clamp part 3 is illustrated at the top in each case and the clamp part 3' is illustrated at the bottom in each case. The clamp parts 3, 3' each have two outer fingers 31, 31' at their free ends. A cutout 32, 32' is provided between the fingers. These cutouts 32, 32' bound a free space 6. In the left-hand half of FIG. 2, said free space 6 has been closed by two slides 5, 5'. The slides 5, 5', which are configured as plates made of metal or plastic, are arranged in a displaceable manner in the respective clamp part 3, 3'. In the left-hand half of FIG. 2, the slides 5, 5' are illustrated in their closing position; in the right-hand half, the slides 5, 5' have been retracted into the respective clamp parts 3, 3' and thus release the free space 6. Although it is only the two end positions of the slides 5, 5', namely the closing position and the releasing position, which are illustrated, it is nevertheless also possible for the slides 5, 5' to assume any desired intermediate positions between these end positions.

Figure 3:
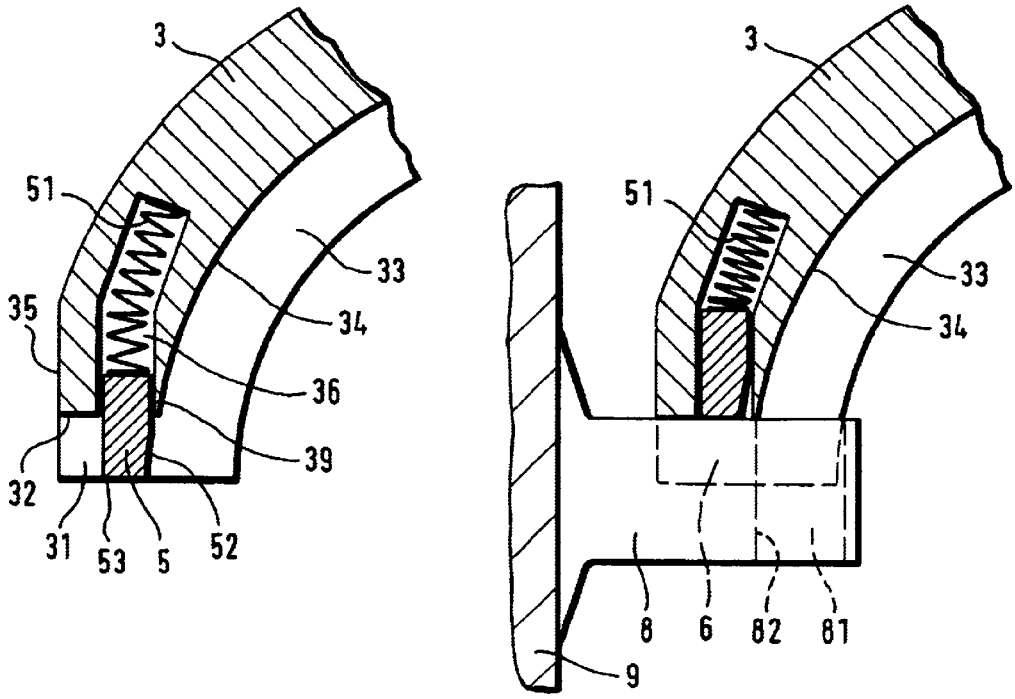
FIG. 3 shows a section through a free end of a clamp part of the tool.

FIG. 3 illustrates a sectional view through the free end using the example of the clamp part 3; the same applies to the clamp part 3'. The guide groove 33 has a groove base 34 which terminates at the free end of the clamp part 3 in the region of the cutout 32. The clamp part 3 has a cavity 36 which extends into the clamp part 3 outside, and approximately tangentially to, the guide groove 33. A slide 5 and a spring 51 are arranged in the cavity 36. The cavity 36 is of rectilinear configuration in its region which is in the vicinity of the cutout 32, and serves for accommodating the slide 5, and is of curved configuration in its region which is remote from the cutout 32, and serves for accommodating the spring 51. The spring 51 is supported on a rear wall of the cavity 36 by way of its rear end and acts on a rear side of the displaceably mounted slide 5 by way of its front end. The left-hand half of FIG. 3 illustrates the slide 5 in its closed position, in which it is retained by stops (not illustrated). The slide 5 can be moved out of this position, into the releasing position, counter to the force of the spring 51. Such a position of the slide 5 is illustrated in the right-hand half of FIG. 3. The slide 5 has been retracted into the releasing position counter to the force of the spring 51. The free space 6 is thus free. It may thus serve for accommodating, for example, a fastening element 8.

Figure 5:
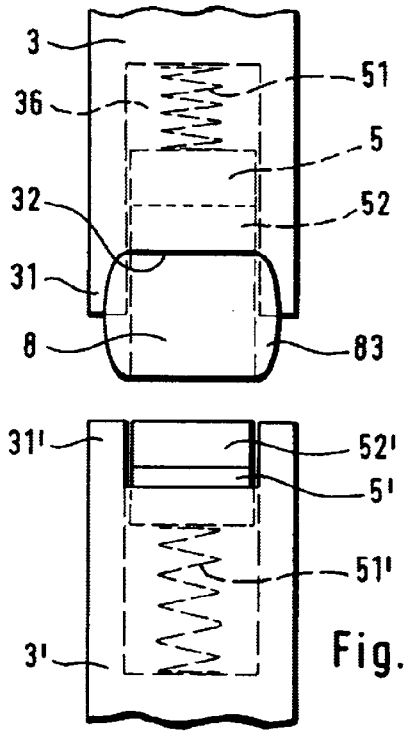
FIG. 5 shows a plan view of the free clamp-part end gripping a fastening element.

The fastening element 8 is arranged on a carrying structure 9 and serves as a fastening point for the object, for example a cable harness, which is to be bound by the tool 1. For fastening purposes, the band by which the cable harness is bound is guided through a passage 81 of the fastening element 8. Provided in the passage 81 is a guide surface 82 which is intended for the band and is provided for aligned interaction with the groove base 34 of the guide groove 33. In order that the tool 1 can easily be moved, by way of its guide groove 33, into this aligned position in relation to the fastening element 8, the fastening element 8 has protrusions 83 on its side directed away from the carrying structure 9 (see FIG. 5). The tool 1 can grip behind these protrusions 83 by way of the fingers 31, 31' of the clamp parts 3, 3' and therefore move the tool, and thus the guide groove 33, into the correct aligned position in relation to the fastening element 8. For reasons of clarity, only the clamp part 3 has been illustrated in each case in FIG. 3; the same applies to the clamp part 3'. Closing the clamp parts 3, 3' then produces a continuous band guide at the free end of the clamp 2. In the case illustrated in the left-hand half of FIG. 3, the band guide is formed by the guide groove 33, with its groove base 34, and, in the region of the free end of the clamp part 3, by the slide 5. This is adjoined by the slide 5' of the clamp part 3' and, finally, by the guide groove 33', with its groove base 34', of the clamp part 3'. This renders the guide path 22 at the free end of the clamp part 3, 3' complete in the region of the free end.

In the case illustrated on the right in FIG. 3, in the region of the free end of the clamp 2, the fastening element 8 is located in the free space 6. The band guide is then formed by the guide groove 33, with its groove base 34, of the clamp part 3, the guide surface 82 in the region of the free end and, adjoining this, the guide groove 33', with its groove base 34', of the clamp part 3' on the opposite side. The band guide is thus completed by the fastening element 8.

The band guide is thus complete in the region of the free end of the clamp parts 3, 3' both whenever a fastening element is arranged in the free space 6 of the free ends of the clamp parts 3, 3' and also whenever there is no fastening element located in the free space 6 between the clamp part 3, 3'. This is achieved by the slides 5, 5', which can be moved between a position in which they close the free space 6 and a position in which they release the free space 6 and which, at least in their closed position, form part of the band guide.

The slides 5, 5' have a hollow 52 on their side which is oriented toward the clamp interior and functions as part of the band guide. The hollow serves for continuing the curved shape of the guide groove 33, 33' even in the regions in which the slides 5, 5' function as a guide. The hollows of the two slides 5, 5' are expediently designed in the manner of half-hollows. If the two slides 5, 5' butt against one another in the closed state of the clamp 2, this produces a complete hollow 52. The latter makes it possible, on the one hand, for the band passing out of the guide groove 33 into the region of the slide 5 to come into contact with the slide 5 at the smallest possible angle and, on the other hand, for the band to be continued in a curved manner and thus for the operation of the band passing from the slide 5' into the guide groove 33' to be simplified.

The section 39 of the clamp part 3 which is located between the groove base 34 of the guide groove 33 and the cavity 51 is of wedge-shaped design. It thus forms a ramp in the region of the transition between the guide groove 33 and the slide 5; the same applies to the clamp part 3'.

Figure 4:
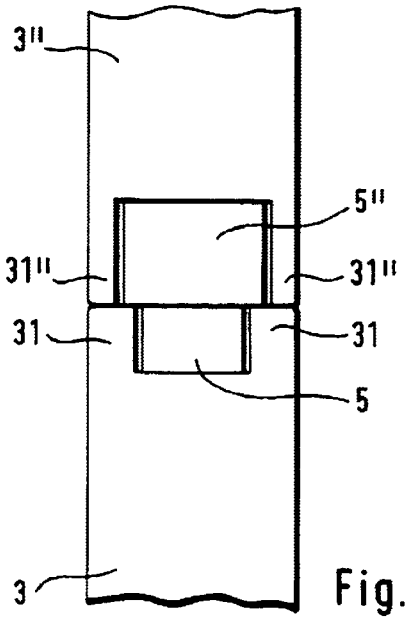
FIG. 4 shows a front view of the free end of clamp parts according to a further embodiment.

Instead of the clamp part 3', which corresponds to the clamp part 3, a different clamp part 3" is provided in FIG. 4. This clamp part 3" differs from the clamp part 3 (and thus also from the clamp part 3') in that the cutout 32 at the free end of the clamp part 3" is wider and deeper than the cutout 32 of the clamp part 3. Accordingly, the fingers 31" are narrower and longer than the fingers 31 of the clamp part 3. The slide 5" (not illustrated) is adapted to the size of the cutout 32" and is thus likewise larger than the slide 5 of the clamp part 3. With this combination of the clamp parts 3 and 3", it is possible for small fastening elements to be accommodated in the region of the cutout 32 of the clamp part 3, and guided reliably by means of the fingers 31, while large fastening elements are accommodated in the cutout 32" and guided reliably by the fingers 31". In this case, in each case only one of the slides 5 and 5" is located in its retracted position. If there is no fastening element located between the free ends of the clamp parts 3, 3", neither of the slides is in the retracted position. It is thus possible for fastening elements of very different sizes, or even for no fastening element, to be retained by the tool, while the band is guided reliably in the process.

What is claimed is:

1. A tool for binding an object by means of a band, said tool having a tool body and a clamp which is at least partially formed by clamp parts with free ends, mounted in a movable manner on the tool body, and is provided with a band guide, it being possible for the clamp parts to be closed such that, in a closed state of the clamp, a free space is produced between their free ends, wherein arranged at a free end of at least one of the clamp parts is a slide which can be moved between a position in which it releases the free space and a closing position and, at least in its closing position, forms part of the band guide.

2. The tool as claimed in claim 1, wherein the clamp part has a cutout which forms the free space.

3. The tool as claimed in claim 2, wherein a spring is provided at the free end of the clamp part, it being possible for the slide to be moved counter to the force of said spring.

4. The tool as claimed in claim 3, wherein provided at the free end of the clamp part is a cavity which is dimensioned for accommodating the slide.

5. The tool as claimed in claim 2, wherein provided at the free end of the clamp part is a cavity which is dimensioned for accommodating the slide.

6. The tool as claimed in claim 2, wherein the slide has a hollow on its side which forms part of the band guide.

7. The tool as claimed in claim 2, wherein the slides are provided on both the clamp parts and are of different dimensions.

8. The tool as claimed in claim 1, wherein a spring is provided at the free end of the clamp part, it being possible for the slide to be moved counter to the force of said spring.

9. The tool as claimed in claim 8, wherein provided at the free end of the clamp part is a cavity which is dimensioned for accommodating the slide.

10. The tool as claimed in claim 8, wherein the slide has a hollow on its side which forms part of the band guide.

11. The tool as claimed in claim 8, wherein the slides are provided on both the clamp parts and are of different dimensions.

12. The tool as claimed in claim 1, wherein provided at the free end of the clamp part is a cavity which is dimensioned for accommodating the slide.

13. The tool as claimed in claim 12, wherein the cavity is of at least partially curved design.

14. The tool as claimed in claim 13, wherein a section of the clamp part which bounds the cavity inside the clamp is of wedge-shaped design.

15. The tool as claimed in claim 13, wherein the slide has a hollow on its side which forms part of the band guide.

16. The tool as claimed in claim 12, wherein the slide has a hollow on its side which forms part of the band guide.

17. The tool as claimed in claim 12, wherein the slides are provided on both the clamp parts and are of different dimensions.

18. The tool as claimed in claim 1, wherein the slide has a hollow on its side which forms part of the band guide.

19. The tool as claimed in claim 1, wherein the slides are provided on both the clamp parts and are of different dimensions.

20. An arrangement for binding an object, comprising a band and a tool, having a tool body and a clamp which is at least partially formed by clamp parts with free ends mounted in a movable manner on the tool body and is provided with a band guide, it being possible for the clamp parts to be closed such that, in a closed state of the clamp, a free space is produced between their free ends, wherein arranged at a free end of at least one of the clamp parts is a slide which can be moved between a position in which it releases the free space and a closing position and, at least in its closing position, forms part of the band guide.

* * * * *